US005137596A

United States Patent [19]

Potter

[11] Patent Number: 5,137,596

[45] Date of Patent: Aug. 11, 1992

[54] APPARATUS FOR HEAT SEALING LABELS ON CONTAINERS

[75] Inventor: Terry C. Potter, Sylvania, Ohio

[73] Assignee: B & H Manufacturing Company, Inc., Ceres, Calif.

[21] Appl. No.: 464,526

[22] Filed: Jan. 12, 1990

[51] Int. Cl.[5] ..... B65C 9/00

[52] U.S. Cl. ..... 156/497; 156/447; 156/458; 156/499; 156/566; 156/568

[58] Field of Search ..... 156/86, 446, 447, 448, 156/449, 456, 457, 458, 499, 566, 568, 497

[56] References Cited

U.S. PATENT DOCUMENTS 4,976,811 12/1990 Siebert ..... 156/497 X

*Primary Examiner*—David A. Simmons
*Assistant Examiner*—James J. Engel, Jr.
*Attorney, Agent, or Firm*—Flehr, Hohbach, Test, Albritton & Herbert

[57] ABSTRACT

Labeling machine for applying labels of heat softenable material to containers comprising a rotating cylindrical vacuum drim which picks up labels in succession at a label receiving station as it rotates, transports each label to a label applying station at which the leading end of each label is applied to a container; means to rotate each container to which the leading end of a label has been applied to wrap the label around the container and to lap the trailing end of the label over the leading end and while so doing to apply pressure to the lapped junction of the leading and trailing ends, and means in the form of a heat applicator located within the drum, extensible through an opening in the drum to bring a head or nozzle into close proximity to the trailing end of a label during most of the travel of such trailing end between the label receiving and label applying positions and to apply heat during such period to the trailing end to soften the trailing end so that it can be welded by pressure to the leading end.

5 Claims, 4 Drawing Sheets

APPARATUS FOR HEAT SEALING LABELS ON CONTAINERS

This invention relates to apparatus for and a method of applying film, labels and the like to articles such as cylindrical containers in which the film, label or the like (hereinafter referred to as "label") is applied to such an article (hereinafter referred to as a "container") wrapping the label around the container, lapping the trailing end of the label over the leading end and securing the leading and trailing ends together by heat and pressure.

FIELD OF THE INVENTION

It is common practice to apply labels to cylindrical containers by adhering the leading end of the label to the body of the container, as by means of adhesive, wrapping the label around the container, lapping the trailing end of the label over the leading end and securing the trailing end to the leading end by means of an adhesive.

BACKGROUND OF THE INVENTION

The adhesive may be a hot melt glue or other separately prepared adhesive or it may be an adhesive formed in situ on the label by application of a solvent which is absorbed into the material of the label and forms a sticky adhesive substance which secures the label. Subsequently the solvent is evaporated.

SUMMARY OF THE INVENTION

Where a hot melt glue (that is a glue which is melted by heat) is used, it may be applied to the container to adhere the leading end of the label to the container and hot melt glue is applied to the trailing end of the label. An example of such practice is described in U.S. Pat. No. 4,108,710. Alternatively the hot melt glue may be applied directly to both the leading and trailing ends of the label as in U.S. Pat. No. 4,181,555.

Glue applied in this manner has certain disadvantages. For example, if containers so labelled are stored or shipped in very cold weather the glue may crystallize and fail.

A disadvantage of the solvent seal method is that it requires equipment to evaporate the solvent and dispose of it without contaminating the environment.

Another method of applying labels to containers which avoids the use of hot melt glue and of a solvent is a method in which label material is wrapped around a spinning mandrel, a label length is severed and the trailing end of the label is lapped over the leading end. Heat and pressure are applied to weld the trailing and leading ends together. The resulting preformed tube is removed from the mandrel and it is then placed over a container and shrunk onto it. This method suffers certain disadvantages. For example, it requires two machines, namely a machine to preform the tubes and another machine to apply the tubes to and shrink them onto containers. Also it is wasteful of material inasmuch as the label material must be made oversize so that the preformed tubes can fit over the containers.

In another method, described in U.S. Pat. No. 4,724,029, heat is applied by a blower to the trailing end of the label to soften it so that it will weld to the leading end. The heat is applied by a fixed blower which is external to the vacuum drum which carries the labels. Such method has disadvantages. For example the blower must be timed to apply heat to the proper area of the label. the difficulty of such timing increases with the speed of the machine. Also the time available for application of hot air is inversely proportional to the machine speed, which sets an upper limit on the speed of the machine.

It is an object of the present invention to provide a method of and apparatus for applying labels to containers which avoid or substantially diminish the aforesaid disadvantages.

It will be understood that the material applied need not be labels but may be, for example, protective and/or decorative covers and that the articles need not be containers. For convenience and brevity "labels" and "containers" will be referred to herein and the invention will be described with reference thereto.

In accordance with the invention a label material is employed which can be softened by heat and when softened and subjected to pressure will create a weld as, for example, at the overlap between the leading and trailing ends of the label. The label is applied in such manner to a container, that is with the trailing end lapping over the leading end, and pressure is applied to weld the heat softened trailing end to the leading end and complete the labeling operation on the container itself. Examples of suitable label material for this purpose are polyethylene and polypropylene label material, also polystyrene. The label material is preferably either non-heat shrinking or if heat shrinkable, it is preferably a material which does not shrink rapidly.

The leading end of the label may be adhered to the container by heating it to soften it provided the container is made of appropriate material, e.g. glass containers (empty or full) or filled plastic containers. However, it is preferred to attach the leading end of the label to the container by an adhesive, e.g. by application of a solvent to the label or by application of a hot melt glue to the container or to the leading end of the label. The attachment of the leading end of the label to the container, e.g. by spots of hot melt glue applied to the leading end, such tacking being sufficient to hold the label on the container until it is fully wrapped and the heat softened trailing end is secured to the leading end.

BRIEF DESCRIPTION OF THE DRAWINGS

Certain embodiments of the invention are shown by way of example in the accompanying drawings, in which.

DETAILED DESCRIPTION OF A PREFERRED EMBODIMENT

Figure 1:
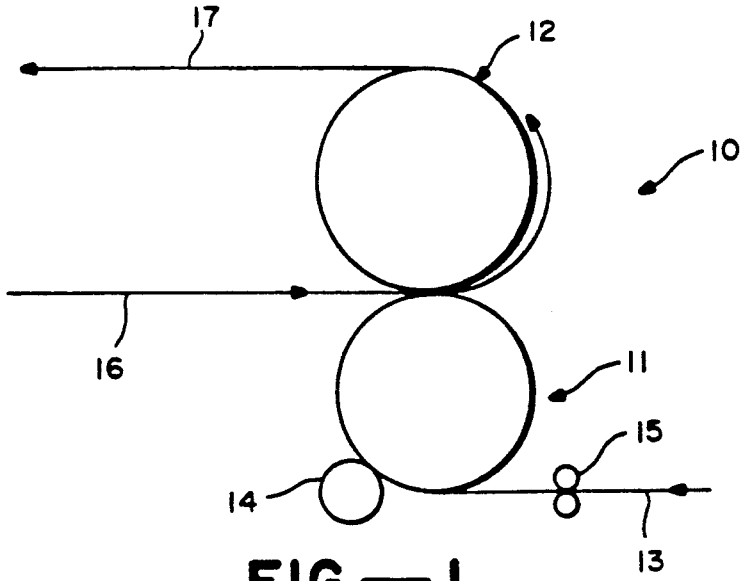
FIG. 1 is a diagrammatic view of that portion of a labeling machine to which the present invention is applicable.

Referring now to FIG. 1, a labeling machine is shown at 10 comprising a vacuum drum 11, a turret 12 such as described in U.S. Pat. No. 4,108,709, a label strip 13 and a glue applicator 14. The strip 13 is a continuous strip coming from a roll by way of suitable feed mechanism (not shown), individual labels being severed by a cutter 15. Suitable feed mechanisms and suitable cutters are well known in the art, being shown, for example, in U.S. Pat. No. 4,108,710. Alternatively, precut labels may be supplied from a stack and extracted and supplied to the vacuum drum by means well known in the art. The vacuum drum may be provided with ridges on its cylindrical surface to elevate the leading and/or trailing ends of the label, e.g. to contact the leading end with a glue applicator 14 to apply a strip or spots of hot melt glue to the leading end of each label whereby it is secured to a container. The turret 12 is supplied with containers entering at 16; each container in turn is brought into tangent contact with the leading end of a label which is adhered thereto; the container with a label so attached is spun to wrap the label around it; and the trailing end is lapped over the leading end and is secured thereto. Labeled containers are released by the turret 12 and leave at 17.

Alternatively, a straight through labeling machine such as that described in Mitchell U.S. Pat. application Ser. No. 200,359, filed May 31, 1988, entitled "STRAIGHT THROUGH LABELING MACHINE" may be used. In such machine containers proceed in a straight line and during transit they are brought into tangent contact with labels on the vacuum drum and are spun after such contact.

Yet another method is that described in U.S. Pat. No. 4,500,386 in which each container, after being brought into contact with the leading end of a label on a vacuum drum, is confined, together with its label, between the cylindrical surface of the vacuum drum and a roll-on pad concentric to the vacuum drum and is caused to spin thereby wrapping the label around it.

Heretofore in machines of these types, the trailing end of the label has solvent or a hot melt glue applied to it to adhere to the leading end of the label to the trailing end. In accordance with the present invention heat is applied to the trailing end to soften it and cause it to weld with and adhere to the leading end.

Figure 2:
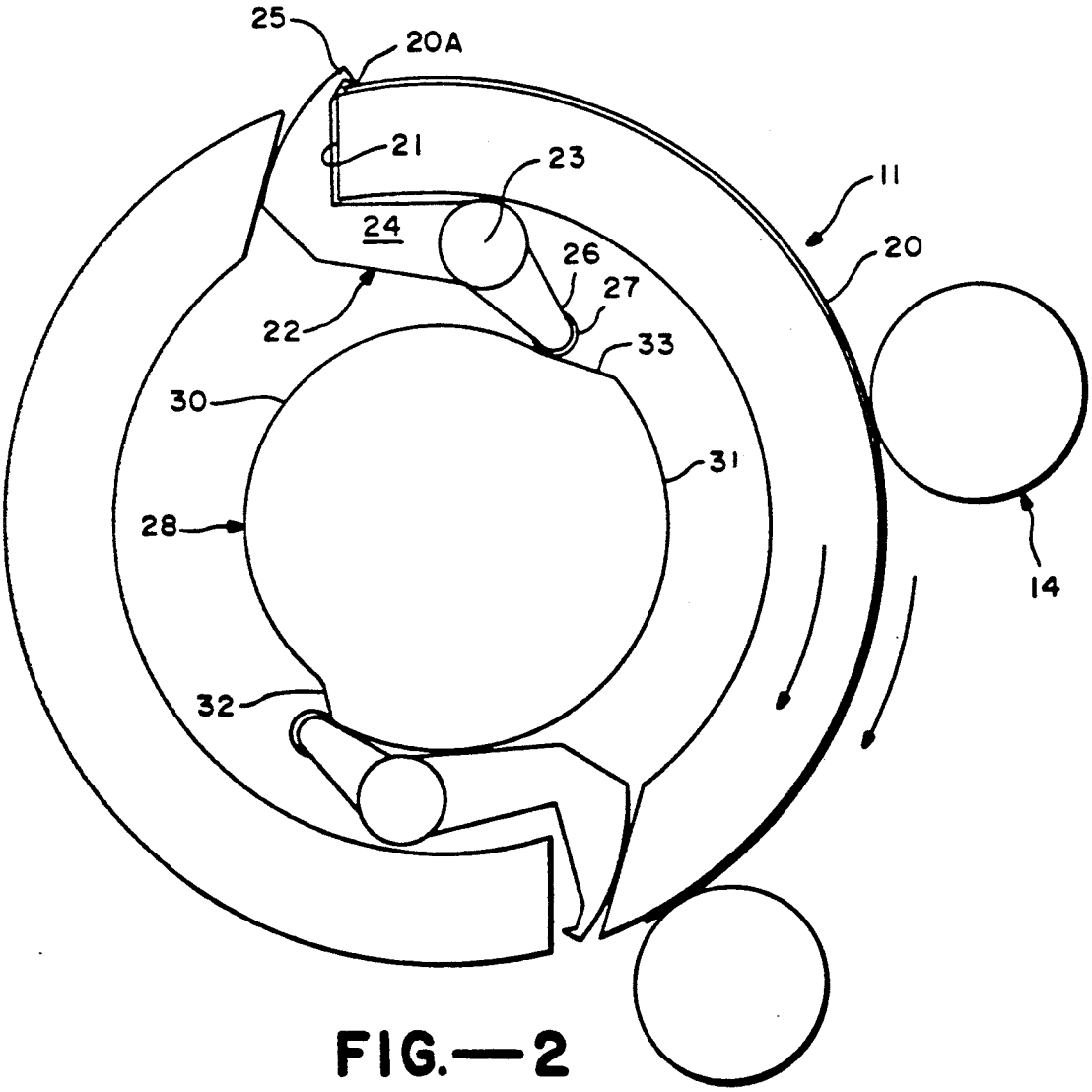
FIG. 2 is a diagrammatic cross sectional view of a vacuum drum such as that shown in FIG. 1 showing the cam and nozzle construction employed to apply heat to the trailing end of a label.

Referring now to FIG. 2, the vacuum drum 11 is shown together with a glue applicator 14 and as having a label 20 on its cylindrical surface. The vacuum drum has one or more (shown as two) openings 21 in the periphery for access of a nozzle 22 pivoted on a stationary shaft 23 which is mounted on the drum 11. The nozzle 22 has a forward portion 24 terminating in a head 25, the portion 24 and head 25 being formed with a passageway and a slit respectively, (neither of which is shown) for passage of hot air to heat the trailing end **20*a* of label 20. The nozzle 22 has a rearward extension 26 which carries a cam follower roller 27 which rides on the surface of a stationary cam 28. The cam 28 has a low dwell 30, a high dwell 31 and a corresponding rise portion 32 and descending portion 33. The cam 28 may be a face cam with a track that confines the cam follower roller 27 or it may be a plate cam and the nozzle 22 may be biased by a spring (not shown) to keep the roller 27** in contact with the cam.

Figure 6:
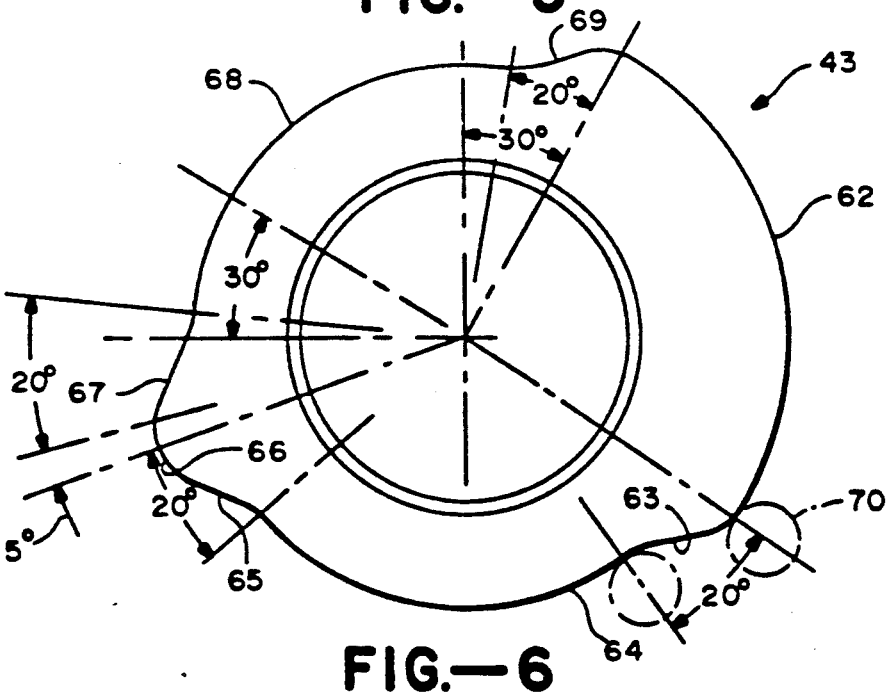
FIG. 6 is a plan view of the cam used to operate the hot air nozzle or nozzles.

The cam 28 is designed so that the nozzle 22 is extended as shown at the top in FIG. 2 so as to apply hot air through tip 25 from a time just after the trailing end **20*a* is placed in the position shown in FIG. 2 until the trailing end is about to leave the vacuum drum. If the glue applicator 14 is of the type which is retracted from the vacuum drum after it has applied glue to the trailing end of the label, such as described in U.S. Pat. No. 4,108,710 at Column 7, lines 25 to 32, this mode of operation is feasible. Alternatively, the glue may be applied in a non-contact manner, e.g. by a remote nozzle and propelled toward the label. If the glue applicator is held at all times in the same position and physically contacts the trailing end of the label and it is necessary to clear any obstruction such as the tip 25 of nozzle 22, the cam 28 may be provided with a second rise portion to accomplish this as shown in FIG. 6** below.

Alternatively, glue may be applied to the container as, for example, in U.S. Pat. No. 4,108,710 in which event the glue applicator 14 may be eliminated.

Hot air may be supplied to the nozzle 22 at the time desired by any suitable means while the trailing end is on the vacuum drum, for example by the means shown in FIGS. 3 and 4 described below.

It will be apparent that by this means hot air is applied to the trailing end **20*a* of the label 20 during most of the time it is on the vacuum drum and will act to soften the trailing end of the label. Therefore, when the softened trailing end of the label is pressed against the leading end, e.g. by means of a pad 48** shown in the FIGURE of U.S. Pat. No. 4,500,386, the leading and trailing ends of the label will be welded together. Other well known means for applying pressure to the overlapping leading and trailing ends of the label may be employed.

Instead of hot air, radiant heat from an electrical heater in the tip of the nozzle may be employed, which is activated in time with the cam 28.

Figure 3:
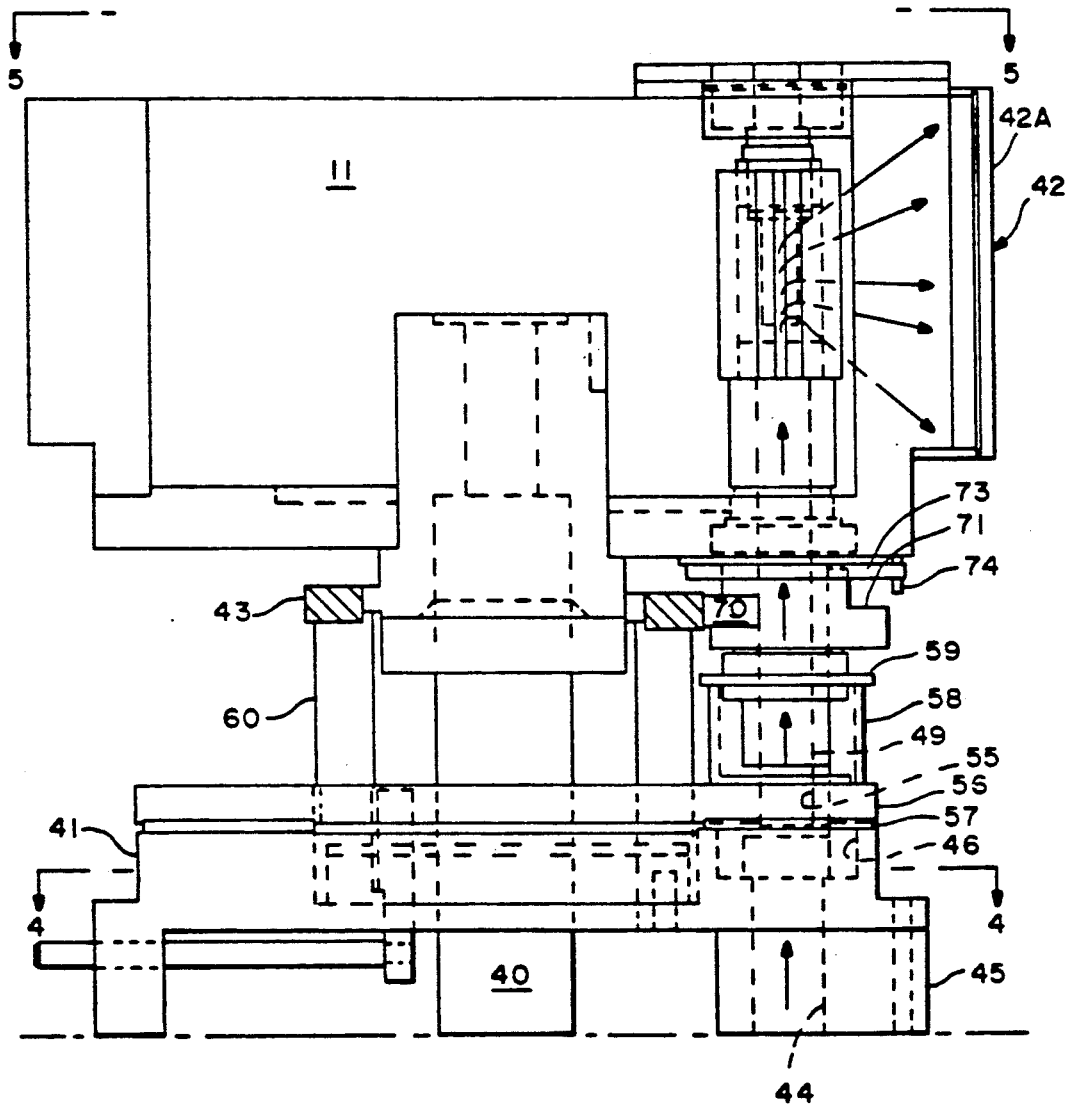
FIG. 3 is a vertical section taken through a vacuum drum such as that shown in FIG. 2 showing the cam and nozzle construction in more detail and also the hot air supply.
Figure 4:
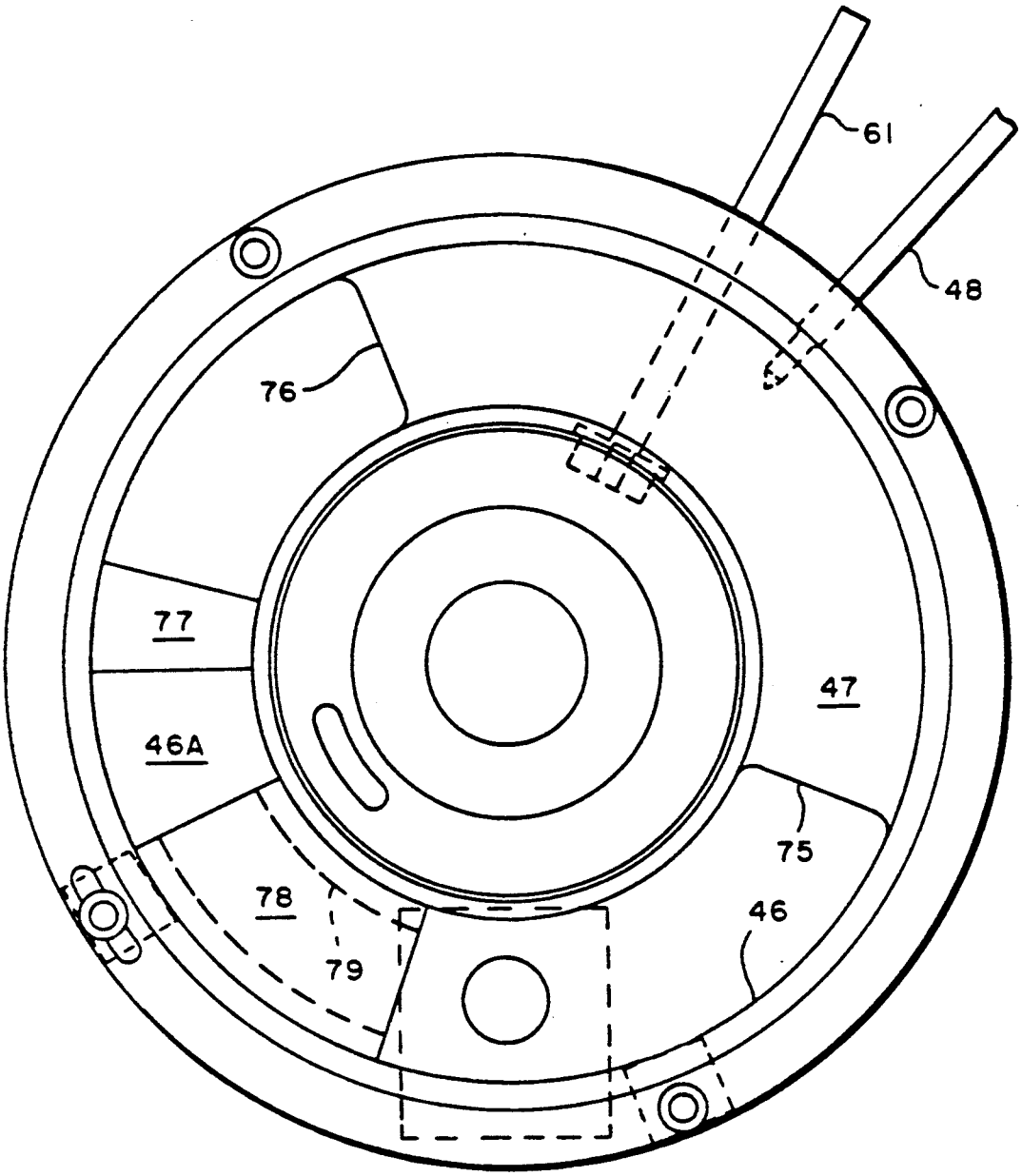
FIG. 4 is a section taken along the line 4—4 of FIG. 3.

Referring now to FIGS. 3 and 4, a vacuum drum 11 is shown mounted on and for rotation with a shaft 40 which is rotatably mounted in the frame 41 of a labeling machine. A nozzle 42 is provided to perform the function described above of the nozzle 22 and a cam 43 is provided to perform the function described above of the cam 28.

A hot air inlet 44 is formed in a stationary part 45 of the machine, such hot air inlet communicating with a source (not shown) of hot air at suitable temperature and pressure, e.g. 1200° F. and 80 psi gauge. The temperature and pressure, particularly the temperature, will vary with the speed of the machine. If the label material is heat shrink material and it is intended to shrink it as in U.S. Pat. No. 4,704,173, the time of exposure of the label material to hot air should be sufficient to soften it but insufficient to shrink it. The hot air inlet communicates with a plenum chamber 46 formed in a plenum block 47. Such plenum chamber is described in more detail below with reference to FIG. 4. The plenum block is stationary but can be adjusted angularly by a rod 48. The plenum forms an arc of a circle and communicates with a tube 49 which carries at its upper end the nozzle 42. The lower end of the tube 49 rests on a sealing plate 56 which is formed with an opening 55 and the plate 56 in turn rests on a wear plate 57 made of Micarta or other suitable material which is in contact with the upper edge of the plenum. An expansion spring 58 confined between a shoulder 59 on the tube and the plate 55 maintains an air tight seal but allows rotation of the tube with the vacuum drum 11 about the latter's axis and also rotation about its own axis.

The cam 43 is supported on a cam support 60 but can be rotated for adjustment by a rod 61 (see FIG. 4) and it has a profile as shown in FIG. 6 including a high dwell 62, a decline 63, a low dwell 64, a rise 65, a short dwell 66, a decline 67, a second low dwell 68 and a rise 69.

Figure 7:
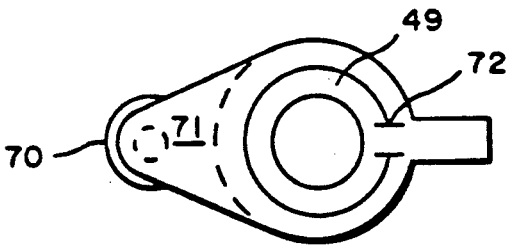
FIG. 7 is a plan view of the cam follower.
Figure 5:
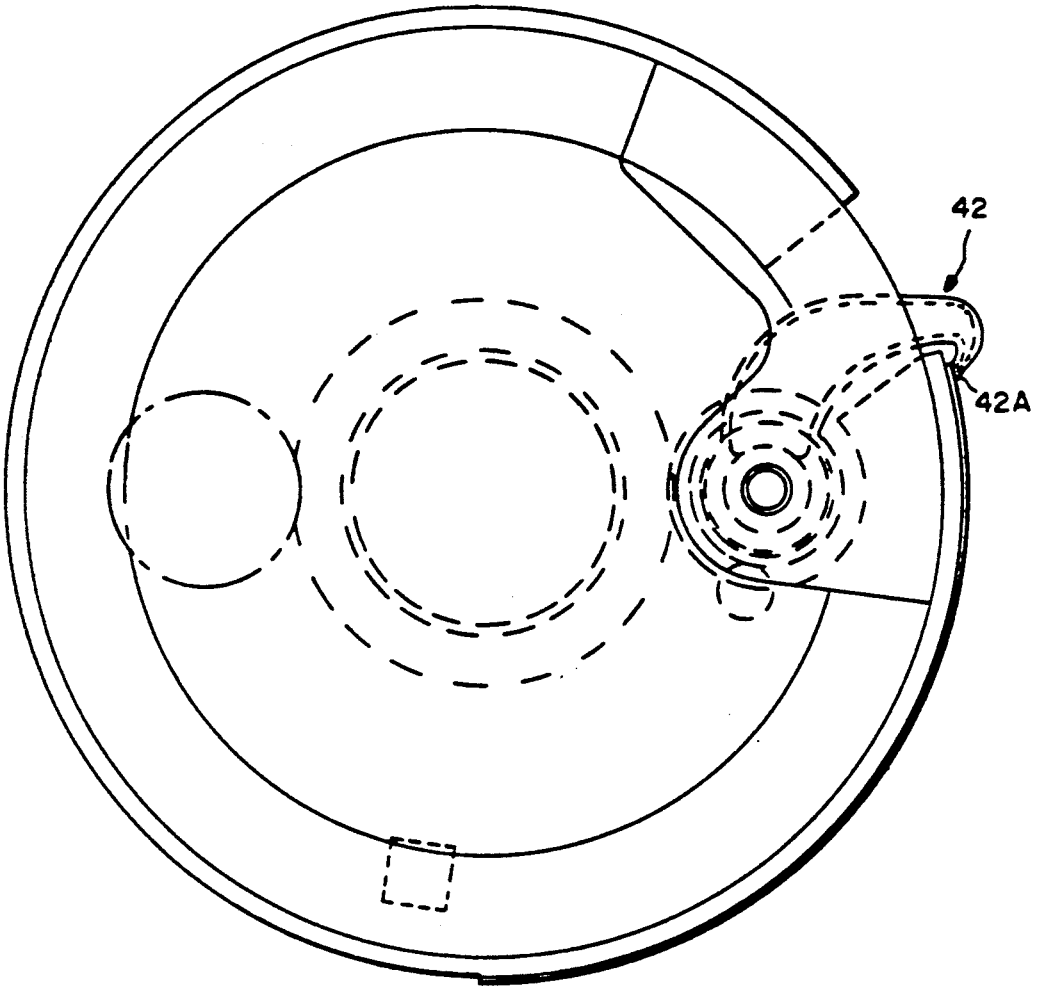
FIG. 5 is a top view taken along the line 5—5 of FIG. 3.

A cam follower roller 70 is rotatably mounted on a bracket 71 which is keyed at 72 see FIG. 7) to the tube 49. A torsion spring 73 is fixed at one end to a pin 74 fixed to the vacuum drum 11 and at its other end it is fixed to the cam bracket 71. This spring holds the cam follower 70 against the cam 43.

The nozzle 42 is fixed to the upper end of the tube 49; it flares out at 42A to at least the width of a label and it is shaped to pass through the opening 21 in the vacuum drum. It will be apparent that as the vacuum drum and with it the tube 49 and the nozzle 42 rotate about the axis of the shaft 40, the nozzle will be held retracted while the cam follower is in contact with the high dwell 62; it will then be extended to deliver hot air while the cam follower is in contact with the low dwell 64; it will again be retracted momentarily while the follower is in contact with the high dwell 66 and will be extended again while the cam follower is in contact with the low dwell 68. The purpose of the high dwell 66 is to retract the nozzle 42 momentarily to clear the glue applicator which applies glue (or solvent) to the leading end of a label. If glue is applied to the container instead of to the label, such clearance will be unnecessary and the high dwell 66 may be eliminated.

Referring now to FIG. 4, the plenum chamber 46 extends between end closures 75 and 76. The effective space is controlled by a tapered plug 77 which may be moved to any desired position. A second moveable plug 78 is provided which has at its lower portion a passage 79 which permits hot air to flow into the space 46A above and to the left of the plug 78 as viewed in FIG. 4. This plug is located in a position such that, as the nozzle 42 passes the glue wheel and is retracted, the hot air supply (which is still operating) will not issue from the nozzle 42, **42*a* and blow the trailing end of the label off of the vacuum drum. The function of the passage is to allow hot air to continue its passage into the space 46A** of the plenum.

It will therefore be apparent that a novel and useful labeling machine has been provided.

I claim:

1. A machine for applying labels or the like to cylindrical containers or the like, such labels being of heat softenable material and each having a leading end and a trailing end, said machine comprising:

(a) a cylindrical vacuum drum mounted for rotation about its cylinder axis and adapted to receive labels in succession on its cylinder surface at a label receiving station, to hold each label on such surface and to transport each label to a label applying station, said drum having an opening in its cylinder surface adjacent and behind the trailing end of a label when placed on such surface, (b) means for applying labels in succession to the cylinder surface of the drum as it rotates with the leading end of each label remote from, and the trailing end of the label close to said opening (c) means for transporting said containers through a path which is tangent to a label on the drum at the label applying station and for rotating each container to wrap a label around the container and to lap the trailing end of the label over the leading end and to apply pressure while so doing (d) and heat applying means for applying heat to the trailing end of each label while it is on the cylinder surface of the drum and while the label is being transported to the label applying station and is being applied to a container, such heat serving to soften the trailing end of the label to enable it to be welded to the leading end by pressure, said heat applying means comprising:

(1) a heat applicator located within the drum and, rotating therewith, said applicator having a head portion which can be extended outwardly through said opening for application of heat to the trailing end of a label on the drum and which can be withdrawn from its extended position for clearance purposes, (2) means for operating said applicator to move it to its extended position and to hold it in such position during a large portion of the travel of a label between the label receiving and label applying stations, and to move the applicator to its withdrawn position when it approaches and passes the label applying station and (3) means to apply heat from said head to the trailing end of each label during such large portion of its travel.

2. The machine of claim 1 wherein said means (3) applies heated air.

3. The machine of claim 2 wherein said means (2) is in the form of a stationary cam located within the drum and cam follower means on the applicator.

4. The machine of claim 3 including a plenum chamber for receiving hot air and which is concentric to the drum, and a tubular passageway connecting said applicator with the plenum chamber.

5. The machine of claim 4 including means to adjust the capacity of the plenum chamber.

* * * * *